US005499881A

United States Patent [19]

Chang

[11] Patent Number: 5,499,881

[45] Date of Patent: Mar. 19, 1996

[54] WRITING IMPLEMENT WITH CORRECTION SUPPLY

[76] Inventor: Pei-Sheng Chang, P.O. Box 82-144, Taipei, Taiwan

[21] Appl. No.: 223,018

[22] Filed: Apr. 5, 1994

[51] Int. Cl.[6] ..... B43K 29/00

[52] U.S. Cl. ..... 401/17; 401/4; 401/21; 401/45; 401/186; 401/258

[58] Field of Search ..... 401/4, 17, 21, 401/22, 26, 44, 45, 47, 183, 186, 258

[56] References Cited

U.S. PATENT DOCUMENTS 1,383,416 7/1921 Mukojima ..... 401/45

2,459,584 1/1949 Quan ..... 401/258 X

*Primary Examiner*—Steven A. Bratlie

*Attorney, Agent, or Firm*—Albert W. Chan

[57] ABSTRACT

A writing implement with correction function including: a barrel; an adjusting member threadedly engaged with an upper end of the barrel; a head member snug-fitted with a lower end of the barrel; a plug snug-fitted with a lower end of the head member; a reservoir tube inserted into the barrel, having an upper end fixedly connected with the adjusting member, and kept in place between the adjusting member and the plug; and correction fluid filled into the barrel, whereby the implement can be used for writing as well as correcting what is wrong.

10 Claims, 3 Drawing Sheets

WRITING IMPLEMENT WITH CORRECTION SUPPLY

BACKGROUND OF THE INVENTION

It has been found that the correction fluid is a useful and efficient tool for correcting what is wrong. However, the correction fluid sold in the marketplace is contained in a plastic bottle so that one must purchase and carry a bottle of correction fluid in addition to a writing implement thereby wasting money and making it inconvenient to use.

Therefore, it is an object of the present invention to provide a writing implement with correction function which may obviate and mitigate the above-mentioned drawbacks.

SUMMARY OF THE INVENTION

This invention relates to a writing implement with correction function.

It is the primary object of the present invention to provide an implement which can be used for writing as well as correcting what is wrong.

It is another object of the present invention to provide a writing implement with correction function wherein the tip of the reservoir tube and the correction function go out of the same hole of the barrel.

It is still another object of the present invention to provide a writing implement with correction function which is simple in construction.

It is still another object of the present invention to provide a writing implement with correction function which is low in cost.

It is a further object of the present invention to provide a writing implement with correction function which is facile to manufacture.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
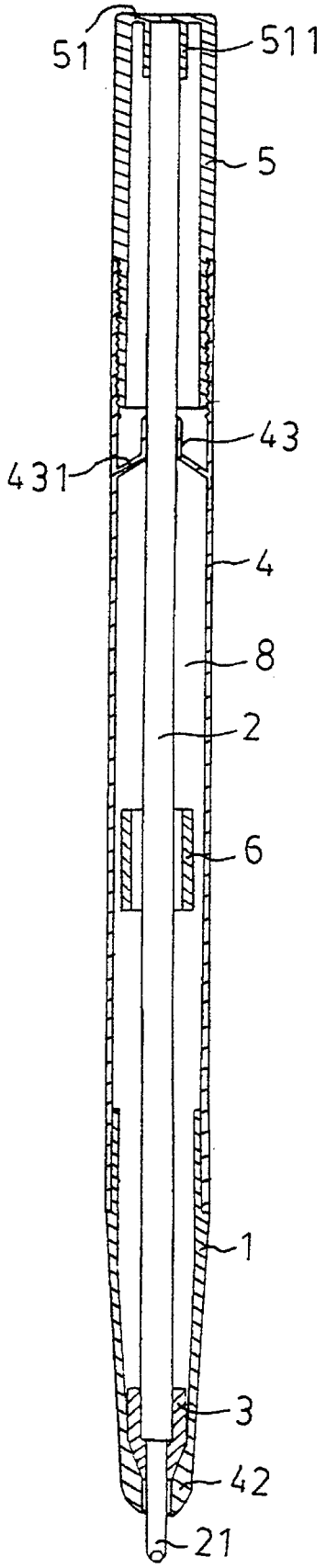
FIG. 1 is a sectional view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the writing implement with correction function according to the present invention mainly comprises a head member 1, a reservoir tube 2, a plug 3, a barrel 4, an adjusting member 5, and a sleeve 6.

As illustrated, the barrel 4 is a resilient tubular member snug-fitted with the head member 1 at the lower end and threadedly engaged with the adjusting member 5 at the upper end. The upper inner end 51 of the adjusting member 5 is formed with a longitudinal tubular portion 511 so that the upper end of the reservoir tube 2 can be force-fitted therein. Further, the barrel 4 is formed with a guide neck 43 which is aligned with the tubular member 511 of the adjusting member 5 and provided with a taper shoulder 431 for facilitating the passage of the reservoir tube 2. A sleeve 6 is loosely disposed between the guide neck 43 and the lower end 42 of the barrel 4. The plug 3 is snug-fitted with the lower end 42 of the barrel 4 so as to prevent the correction fluid 8 from leaking out between the plug 3 and the head member 42. The reservoir tube 2 is arranged in the barrel 4, with its upper end force-fitted with the tubular portion 511 of the adjusting member 5 and its lower end extending out of the plug 3 and the lower end 42 of the barrel 4. Correction fluid 8 is filled into the barrel 4.

When in use, first shake the present invention so that the sleeve 6 will stir well the correction fluid 8 in the barrel 4. Then, rotate the adjusting member 5 to raise the reservoir tube 2 thereby forming a clearance between the reservoir tube 2 and the plug 3 and lightly squeeze the barrel 4 to let the correction fluid 8 flow out of the head member 42.

Figure 2:
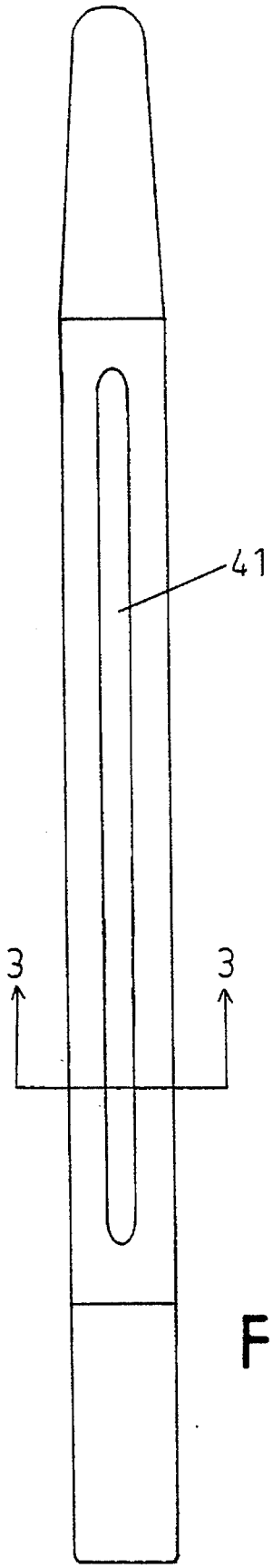
FIG. 2 is a side view of the present invention.
Figure 3:
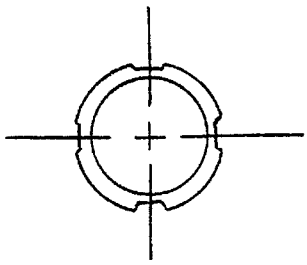
FIG. 3 is a sectional view taken along line 3—3 of FIG. 2.

Looking now at FIGS. 2 and 3, the barrel 4 is provided with a plurality of recesses 41 so as to increase the strength thereof and make it easier to compress the correction fluid out of the barrel 4.

Figure 5:
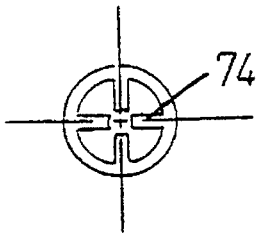
FIG. 5 is a top view of the cap.
Figure 4:
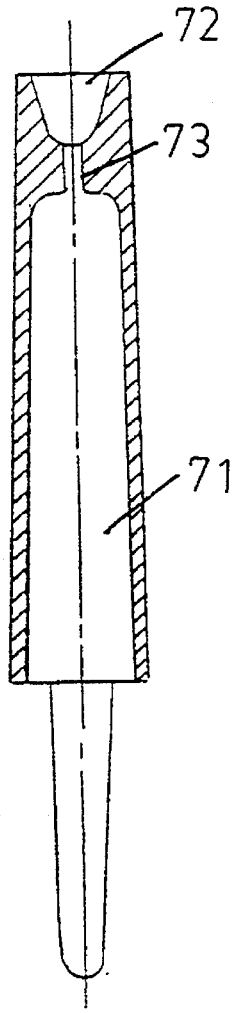
FIG. 4 is a sectional view of the cap.
Figure 6:
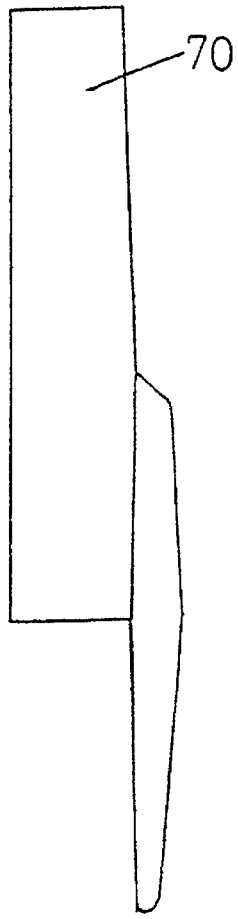
FIG. 6 is a side view of the cap.

Referring to FIGS. 4, 5 and 6, the cap 70 is formed at the lower end with an elongated chamber 71 for receiving the head member 42 of the barrel 4 and at the upper end with a recess 72 for clearing the correction fluid solidified on the head member 42 of the barrel 4 and the tip 21 of the reservoir tube 2. In addition the recess 72 is communicated with the elongated chamber 71 through a center hole 73. The recess 72 is formed with a plurality of radial webs 74. When desired to clear the correction fluid solidified on the head member 42 of the barrel 4 and the tip 21 of the reservoir tube 2, it is only necessary to engage the recess 72 of the cap 70 with the head member 42 of the barrel 4 with its center hole 73 receiving the tip 21 of the reservoir tube 2 and then turn the cap 70 to remove the correction fluid.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A writing implement with correction function comprising:

a barrel;

a reservoir tube inserted into said barrel and extending out said barrel at an opening; and correction fluid filled into said barrel and capable of flowing out of said barrel through said same opening.

2. The writing implement with correction function as claimed in claim 1, further comprising:

an adjusting member threadedly engaged with an upper end of said barrel;

a head member snug-fitted with a lower end of said barrel; and a plug snug-fitted with a lower end of said head member;

said barrel having an upper end fixedly connected with said adjusting member, and kept in place between said adjusting member and said plug.

3. The writing implement with correction function as claimed in claim 1, further comprising a sleeve loosely fitted over said reservoir tube.

4. The writing implement with correction function as claimed in claim 2, further comprising a cap formed at a lower end with an elongated chamber for receiving said head member and at an upper end with a recess formed with a plurality of webs.

5. The writing implement with correction function as claimed in claim 4, wherein said recess is communicated with said elongated chamber.

6. The writing implement with correction function as claimed in claim 1, wherein said barrel is formed with a coaxial guide neck.

7. The writing implement with correction function as claimed in claim 2, wherein said adjusting member is formed with a tubular portion for receiving an upper end of said reservoir tube.

8. The writing implement with correction function as claimed in claim 1, wherein said barrel is made of resilient material.

9. The writing implement with correction function as claimed in claim 1, wherein said barrel is formed with a plurality of longitudinal recesses.

10. The writing implement with correction function as claimed in claim 6, wherein said guide neck is formed with a taper shoulder.

* * * * *